United States Patent [19]

Rast et al.

[11] Patent Number: 4,529,014

[45] Date of Patent: Jul. 16, 1985

[54] LOOM REED WITH PLASTIC PROFILED DENTS

[75] Inventors: John L. Rast, Greer; Wayne A. Hall, Taylors; Charles F. Kramer; William L. Stenhouse, both of Greenville, all of S.C.

[73] Assignee: Steel Heddle Mfg., Co., Greenville, S.C.

[21] Appl. No.: 527,129

[22] Filed: Aug. 29, 1983

[51] Int. Cl.[3] ..... D03D 47/30

[52] U.S. Cl. ..... 139/435; 139/192

[58] Field of Search ..... 139/435, 188 R, 192

[56] References Cited

U.S. PATENT DOCUMENTS

| | | | |
|---|---|---|---|
| 4,354,534 | 10/1982 | Sulser et al. | 139/435 |
| 4,380,254 | 4/1983 | Bonasch et al. | 139/435 |
| 4,457,344 | 7/1984 | Marti | 139/192 |

FOREIGN PATENT DOCUMENTS

| | | | |
|---|---|---|---|
| 02965 | 9/1983 | United Kingdom | 139/435 |

*Primary Examiner*—Henry S. Jaudon

*Attorney, Agent, or Firm*—Dority & Manning

[57] ABSTRACT

A loom reed (10) comprised of plastic dent strips (A, B) is illustrated having a profiled section (32, 34) which is reinforced for weft yarn beat-up into the cloth (C). The profiled section includes a web (38, 48) of reduced thickness which creates additional air space facilitating passage of knots and the like in the warp yarn through the space between adjacent dent strips. A rim (40, 50) created by the reduced web maintains the warp yarn generally out of contact with the remaining plastic surface of the dent to reduce surface drag and friction. A metal insert (56) is utilized in the dent strips at the edge of the reed for additional stiffness where the cloth beat-up forces are attenuated. A tunnel forming recess (36, 52) is formed in the dent strips to form a tunnel across a length of the reed facilitating weft insertion by containment of a fluid jet. Various means to expedite the assembly of the dent strips into a reed are provided one of which (60, 66) eliminates the need for conventional channel strips (12, 14). Tunnel alignment means are provided by complementary protuberances (70, 74) and indentations (72) aligning the ends and thus the individual recesses (52) across the tunnel length.

30 Claims, 8 Drawing Figures

LOOM REED WITH PLASTIC PROFILED DENTS

BACKGROUND OF THE INVENTION

The invention relates to a reed for beating-up the weft yarn into the cloth woven on a loom. The reed typically includes a plurality of spaced flat wire dents arranged in a row defining spaces between the dents through which the warp yarn ends pass. During the weaving, the reed oscillates to and fro to push the recently inserted weft yarn into the cloth at the fell of the cloth. The reed must be able to withstand rapid cyclic beat-up motions during weaving.

With the advent of high speed shuttleless looms, the speed at which the reed must oscillate is dramatically increased. Furthermore, the inertial forces produced by the prior conventional reed constructions have rendered many conventional constructions unsuitable for high speed shuttleless loom operation. All of which have required that considerable attention be given to the construction of reeds for jet looms.

For a shuttleless jet type loom in which the weft yarns are introduced into the shed of the cloth by means of a jet of gaseous fluid, such as air, the dents are provided with recesses, such as shown in U.S. Pat. No. 4,116,243 which form a channel for the gaseous fluid and weft yarn carried thereby. The metal dent needs are heavy and the widened recess portion of the dent is susceptible to imparting heavy drag on the yarn passing thereagainst.

Thus, not only are reeds for shuttleless looms driven at higher speeds, but the reeds by necessity of the shapes of the dents become heavier. In the case of water jet looms, the water often has a corrosive effect on the wire dents.

The forces encountered by the individual dents of a reed which push the weft forward into the fell during beat-up of the cloth are substantial when considering the speed and resultant forces involved. The high speed cyclic nature of the movement of the reed during beat-up also attenuates the forces on the individual dents of the reed.

The lowering of inertial forces by providing more lightweight subassemblies, such as the reed frame, for looms particularly shuttleless high speed looms, is one to which considerable attention needs to be given in order to meet the demands of high speed weaving technology.

Accordingly, an important object of the present invention is to provide a lightweight reed for a shuttleless high speed loom having reduced inertial forces without loss in structural strength.

Still another important object of the present invention is to provide a plastic profiled dent for a lightweight reed having reinforcement for beat-up on the loom.

Still another important object of the present invention is to provide a dent for a reed which makes assembly of the reed more simplified and accurate.

Yet another important object is to provide a dent for a reed offering less resistance to the passage of warp yarn ends passing between the dents.

Still another important object of the present invention is to provide a plastic dent strip for forming a reed which includes self-locking features such that adjacent heddle strips interlock with each other to align themselves in the reed frame.

Still another important object of the present invention is to provide a reed having a number of plastic dent strips which include profiled sections having a tunnel forming recess therein wherein the recess area is reinforced for beating-up the cloth.

Still another important object of the present invention is to provide a plastic dent strip having a tunnel forming recess having self-aligning features interlocking the dent strips with one another so that an aligned continuous tunnel is formed across the reed.

SUMMARY OF THE INVENTION

The above objectives are accomplished according to the present invention by providing a reed constructed from a plurality of plastic dent strips having opposing free ends and a profiled medial section. A tunnel forming recess is formed in the profiled section which forms a weft insertion tunnel across the reed through adjacent profiled dent strips. Ends of the dent strips include interlocking alignment means for aligning the tunnel recesses of the adjacent dent strips across the width of the reed. The reed frame itself may be made by interlocking the ends of the individual dent strips together and securing the same in lieu of the conventional channel strip which is used on the tops and bottoms of the reed. The width of the ends of the dent strips may be accurately dimensioned to fit into the standard clamp of the lay drive. The profiled section includes a reduced side web which creates a rim surrounding web which maintains the warp yarn away from the side of plastic dent strip to reduce friction of the warp yarn ends. More air space is permitted by adjacent side webs for easier passage of knots and the like. The rear wall of the profiled section is bowed outwardly to provide additional stiffening and reinforcement means for the individual dent strips during cloth beat-up. The dent strips at the cloth edge of the reed include a longitudinal stiffening element extending in the length dimension to increase stiffness at the cloth edge to offset the greater side forces caused by cloth contractions. The free ends of the dents which are assembled together are also provided with spacer means which automatically provides a uniform and parallel air space between the dents facilitating passage of the warp yarn.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, which show an example of the invention and wherein.

DESCRIPTION OF A PREFERRED EMBODIMENT

The invention relates to a weaving reed and to dents made therefor. Since the construction and operation of a reed on a loom is well known in the art, only those parts of the reed and its operation as are necessary to an understanding of the invention are illustrated.

Figure 1:
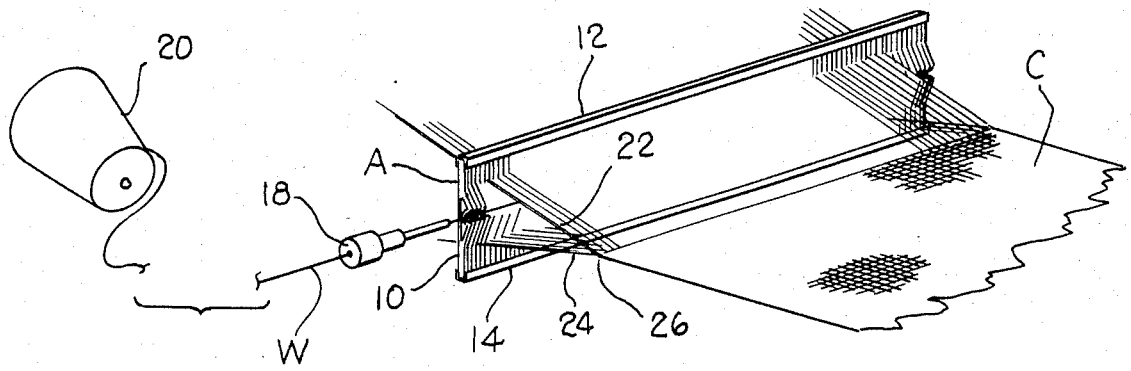
FIG. 1 is schematic illustration of weft yarn insertion on a shuttleless jet loom and reed for beating-up the weft yarn accordingly.

Accordingly, FIG. 1 illustrates a reed frame 10 which includes an upper channel strip 12 and a lower channel strip 14 having interior channels in which the ends of a plurality of reed dents A are fitted and secured by any suitable means such as adhesive bonding. The lower channel strip 14 is the clamping side of the reed frame and is clamped on a lay beam of the loom by which the beat-up action is imparted to the reed.

A weft insertion device is illustrated schematically at 18 which inserts a weft yarn W coming from a supply package 20 through a shed formed between the parted upper and lower warp yarns 22 and 24 as illustrated. The inserted weft yarn is then beaten-up into the cloth at the fell 26 of the cloth. The reed undergoes a driving motion from the position shown in FIG. 1 to a beat-up position at the fell 26 of the cloth by means of a conventional reed lay drive.

Figure 3:
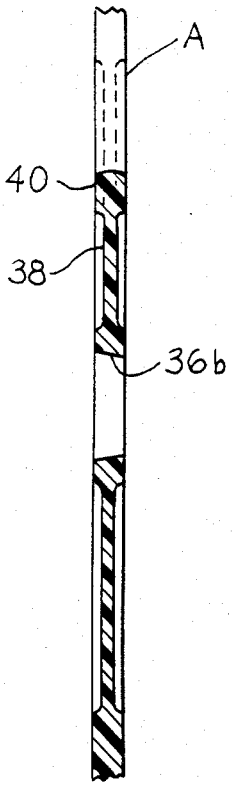
FIG. 3 is a sectional view taken along line 3—3 of FIG. 2 which is doubled in relative size.

Referring now in more detail to the invention, a plastic dent strip A is illustrated which includes a plastic strip 30 having a pair of free ends 30*a* and 30*b*. A profiled section 32 is formed between the free ends and joined thereto by shank portions 34*a* and 34*b*. A tunnel recess 36 is formed in the profiled section. A reduced reinforcing web 38 is formed in the profiled section which is reduced in thickness compared to the plastic strip 30 as can best be seen in FIG. 3. The reduced web defines a rim means 40 about the profiled section and the web and rim tend to reinforce the dent strip against the beat-up forces encountered as the back of the recess space 36*a* strikes the weft yarn to push it forward and beat it up into the fell of the fabric. Recess 36 is beveled at 36*b* in the direction of weft insertion to facilitate weft insertion through the tunnel formed by a series of strips by a jet of air.

The reduced thickness of the web 38 creates additional air space between webs of adjacent dent strips for easier passage of warp yarns and knots. The rim 40 maintains the warp yarns out of contact with side web 38 to reduce drag and friction.

Figure 5:
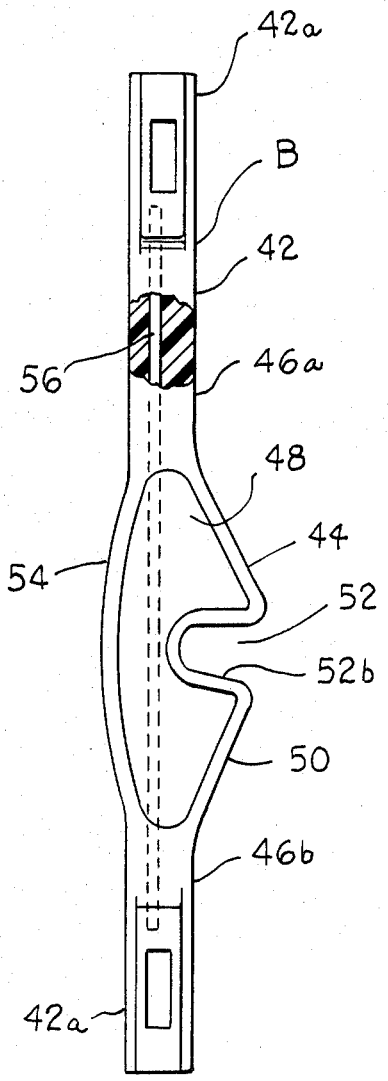
FIG. 5 is a side view of an alternate embodiment of a plastic profiled dent strip constructed according to the present invention.

Referring now to FIG. 5, an alternate embodiment of the invention is illustrated wherein a dent strip B is constructed from a strip 42 of suitable plastic material. The dent strip includes opposing free ends 42*a* and 42*b*. A profiled medial section 44 is disposed between the free ends and joined thereto by shank portions 46*a* and 46*b*. The profiled section includes a reduced side web 48 which is reduced in thickness relative to the plastic strip defining a rim means 50 generally about the web and profiled section. Reduced web means 48 creates a wider air space 51 facilitating warp yarn and knot passage. Web means 48 and rim means 50 function as do their counterparts 38 and 40 of dent strip B described above. A tunnel recess 52 is formed in the profiled section. A rear wall of the profile section 54 is bowed outwardly to reinforce the dent strip and provide additional stiffness for encountering the cloth beat-up forces which is contoured by rim means 50.

It is preferred that the dent strips at the edge of the reed frame include longitudinal stiffening means in the form of a longitudinal wire element 56 which extends and is imbedded in the plastic strip material from adjacent one end to the other. The metal insert is used to improve the stiffness of the cloth edge dents to offset the greater side forces against these dents caused by cloth contractions at the edges.

In one embodiment, the ends of the dent strips are supported in standard aluminum channels 12 and 14, top and bottom, with the ends firmly potted in an epoxy adhesive. The channels also serve to help retain accurate dent-to-dent alignment along the length of the reed as is necessary in order to establish front-to-back and top-to-bottom alignment of the tunnel forming recesses 36, 52 for reliable weft insertion. Notches 58 in dent A may be provided to fit with complementary ridges formed in the metal channel strips to align the dent strips in the frame. Alternate means will also be described hereinafter. A conventional spacer spring may be utilized in manufacture to space the plastic dents as well as the spacer means disclosed herein which are advantagously incorporated into the dent structure in a new and unique manner.

Figure 6:
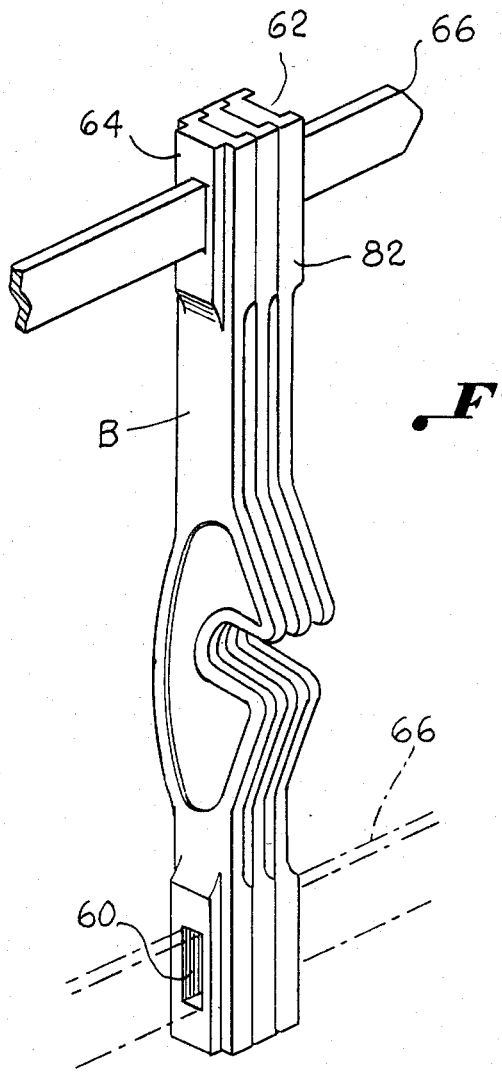
FIG. 6 is a perspective view of the assembly of a number of profiled plastic dent strips constructed according to the present invention illustrating a method of forming a reed frame by assembling, aligning, and interlocking ends of the dent strips together.

It is also contemplated that the reeds may be assembled in frame form by means of securing the interfacing ends of adjacent dent strips together by suitable means molded into the ends. In one embodiment, in FIG. 6, a rod slot opening 60 is formed in opposing ends of the dent strip having a rectangular shape. One side of each opposing end has a channel groove 62 formed therein and the opposing side has a thickened channel block or tongue 64 molded therein which nests with the channel groove of an adjacent strip. A frame assembly bar means 66 forms a tight fit and is received through the rod slot opening 60 on both ends of the individual dent strips. In this manner, the individual dent strips may be fitted and interlocked together against vertical and horizontal movement. The rod bar 66 prevents vertical movement while the tongue and groove arrangement 62, 64 prevents horizontal back-to-front movement and misalignment. Thus, the heddle strips are affixed in their vertical and horizontal positions relative to each other in alignment along the length of the reed. Adhesive, a laser beam, or ultrasonics can be used to permanently join the adjacent dents to a sturdy full length reed in this manner without need of a channel strip. The ends are dimensioned to fit exactly into the clamp of the lay drive.

Figure 7:
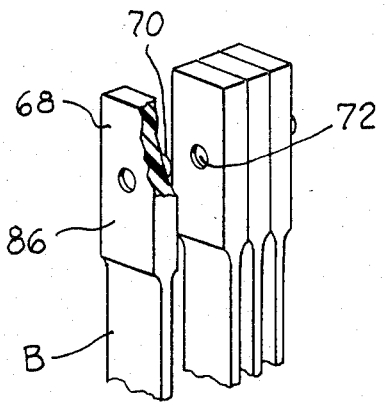
FIG. 7 is a perspective view illustrating interlocking alignment features of the ends of plastic dent strips constructed according to the present invention for self-aligning the individual dent strips in the reed frame.
Figure 8:
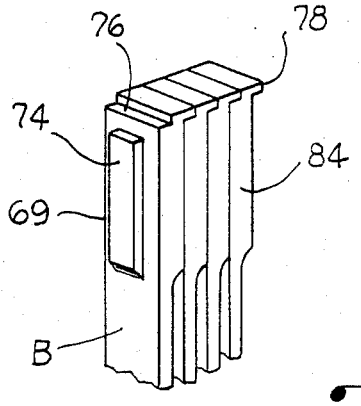
FIG. 8 is a perspective view illustrating an alternate embodiment for interlocking alignment features for the ends of the individual dent strips constructed according to the present invention.

Alternately, the top-to-bottom alignment or vertical position of the individual dent strips in the reed may be had by a protuberance and complementary indentation arrangement as illustrated in modified dent strip ends 68 and 69 of FIGS. 7 and 8. In FIG. 7, a pin protuberance 70 and a pin hole indentation 72 are provided for interlocking the mating faces of ends of adjacent dent strips. In FIG. 8, a rectangular protuberance having intersecting sharp edges 74 is carried on one face of each end of the individual dent strips and on the interfacing end of the individual dent strips a complementary rectangular shaped indentation is formed (not shown) in which the rectangular protuberance 74 fits exactly and tightly. A corner cut-out 76 provides nesting of ledge 78 of adjacent dent strips. By this means, misalignment of the tunnel recesses of adjacent dent strips is avoided and a reliable tunnel length is established.

Figure 4:
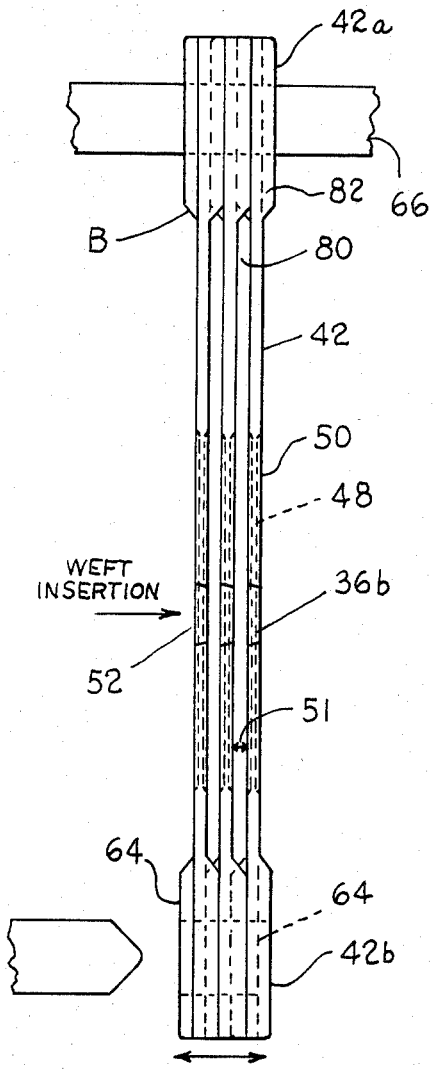
FIG. 4 is a front view of a reed incorporating profiled plastic dent strips constructed according to the present invention.
Figure 2:
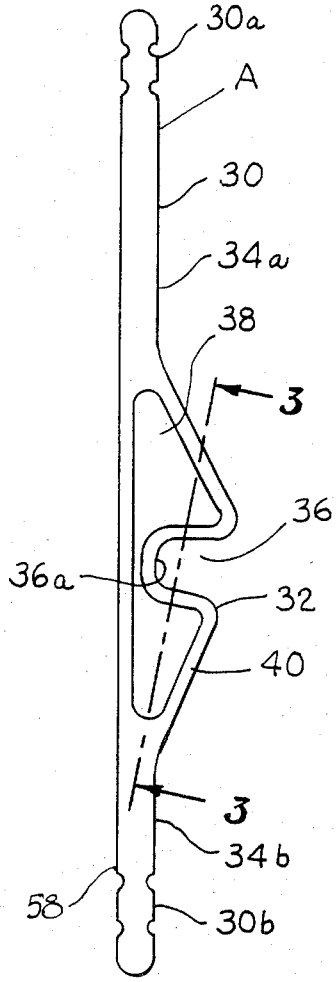
FIG. 2 is a side elevation illustrating a plastic profiled dent strip constructed according to the present invention.

Means for spacing the individual dent strips A or B laterally to define uniform parallel air spaces 80 therebetween is provided by molded features of the ends 42*a*, 42*b*, and 30*a*, 30*b* of the dent strips. As can best be seen in FIG. 4, this air space facilitates the passage of the warp ends between the dent strips. This space may be provided by an increased thickness at the ends of the dent strips provided by molded material 82 which is increased relative to the plastic strip for forming tongue groove 62. Additional molded spacer thickness is provided at 84 in dent end 69 and 86 in dent end 68. Two molded thicknesses in interfacing ends 68 provide the spacing in that case.

The edge of the tunnel recess of each dent strip is beveled or inclined just a few degrees in the direction of weft insertion at 36*b* in the case of dent strip A and 52*b* in the case of dent strip B. The beveled edges assist in condensing the air jet along the length of the tunnel formed by the series of side-by-side dent strips to help retain the effectiveness of the air jet through the tunnel along the length of the reed frame.

In practice, the dent strips can be molded from any suitable reinforced plastic such as fiberglass, or glass filled nylon. Carbon fiber reinforcement may also be utilized as additional reinforcement means to the previously described reinforcement features.

In practice, straight dent strips may be utilized on the edges of the reed frame at the cloth edges for beat-up and the remaining dent strips may be profiled to include medial profiled sections such as at 32 and 44.

While a preferred embodiment of the invention has been described using specific terms, such description is for illustrative purposes only, and it is to be understood that changes and variations may be made without departing from the spirit or scope of the following claims.

What is claimed is:

1. A reed for beating-up a weft yarn at the fell of woven fabric on a textile loom having a row of dents providing dent spaces through which individual warp yarn ends pass, said reed comprising:

a plurality of elongated profiled dent strips constructed of plastic material having opposing free ends;

assembly means securing said free ends of said dent strips in fixed relation whereby said dent strips are arranged to form a reed frame;

spacer means spacing said dent strips for creating air spaces between adjacent dent strips permitting passages of said warp yarn ends therethrough;

a number of said dent strips including a medial profiled section;

said dent strips including a shank portions connecting said medial profiled section and said free ends;

a tunnel forming recess formed in said profiled section creating a weft insertion tunnel through dent strips arranged serially side-by-side which contains the weft yarn and assists in guiding said yarn during insertion;

beat-up reinforcing means included in each said dent strip for reinforcing said plastic profiled section against forces produced on said dent strips during beat-up of cloth; and said reinforcing means including a convex, rearwardly extending portion opposite said tunnel forming recess.

2. The reed of claim 1 including longitudinal stiffening means carried by a number of said dent strips arranged in said reed adjacent the cloth edge of said reed for stiffening said dent strips for cloth beat-up at the edges of the cloth.

3. The reed of claim 1 including tunnel recess alignment means carried by the ends of said dent strips for interlocking and arranging the individual dent strips in position relative to each other so that the front-to-back top and top-to-bottom alignment of said tunnel recesses of said dent strips is provided.

4. The reed of claim 1 wherein said tunnel recesses are beveled in the direction of weft insertion to condense a fluid jet which inserts the weft yarn through said tunnel and assist in retaining its effectiveness over the tunnel length.

5. The reed of claim 1 wherein said profiled medial section of said plastic dent strips is widened in the direction of fabric beat-up relative to said shank portions.

6. The reed of claim 1 including rim means carried about said medial profiled section reinforcing said dent strip profiled section and holding said warp yarn ends away from said plastic strip reducing drag and friction therebetween.

7. The reed of claim 6 wherein said reinforcing rim surrounds said tunnel recess.

8. A reed for beating-up a weft yarn at the fell of woven fabric on a textile loom having a row of dents providing dent spaces through which individual warp yarn ends pass, said reed comprising:

a plurality of elongated profiled dent strips constructed of plastic material having opposing free ends;

assembly means securing said free ends of said dent strips in fixed relation whereby said dent strips are arranged to form a reed frame;

spacer means spacing said dent strips for creating air spaces between adjacent dent strips permitting passages of said warp yarn ends therethrough;

a number of said dent strips including a medial profiled section;

said dent strips including shank portions connecting said medial profiled section and said free ends;

a tunnel forming recess formed in said profiled section creating a weft insertion tunnel through dent strips arranged serially side-by-side which contains the weft yarn and assists in guiding said yarn during insertion;

beat-up reinforcing means included in each said dent strip for reinforcing said plastic profiled section against forces produced on said dent strips during beat-up of cloth;

slot openings formed in ends of dents; and dent assembly bar means extending consecutively and continuously through said slot openings for assembling said plastic dent strips together to create said reed frame and align said recesses to form an aligned weft insertion tunnel.

9. A reed for beating-up a weft yarn at the fell of woven fabric on a textile loom having a row of dents providing dent spaces through which individual warp yarn ends pass, said reed comprising:

a plurality of elongated profiled dent strips constructed of plastic material having opposing free ends;

assembly means securing said free ends of said dent strips in fixed relation whereby said dent strips are arranged to form a reed frame;

spacer means spacing said dent strips for creating air spaces between adjacent dent strips permitting passages of said warp yarn ends therethrough;

a number of said dent strips including a medial profiled section;

said dent strips including shank portions connecting said medial profiled section and said free ends;

said plastic dent strips being reduced in thickness in the area of said medial profiled section to define a reduced side web in the area of warp yarn passage;

a tunnel forming recess formed in said profiled section creating a weft insertion tunnel through dent strips arranged serially side-by-side which contains the weft yarn and assists in guiding said yarn during insertion; and beat-up reinforcing means included in each said dent strip for reinforcing said plastic profiled section against forces produced on said dent strips during beat-up of cloth.

10. A reed for beating-up a weft yarn at the fell of woven fabric on a textile loom having a row of dents providing dent spaces through which individual warp yarn ends pass, said reed comprising:

a plurality of elongated profiled dent strips constructed of plastic material having opposing free ends;

assembly means securing said free ends of said dent strips in fixed relation to form a reed frame;

a number of dent strips including a medial profiled section;

said dent strips including shank portions connecting said medial profiled section and said free ends;

a tunnel forming recess formed in said profiled section creating a weft insertion tunnel in dent strips arranged consecutively side-by-side which contains the weft yarn and assists in guiding said yarn during insertion;

reinforcing means for reinforcing said dent strip against beat-up; and side web means formed in said profiled section reduced in thickness creating additional air space between adjacent dent strips and profiled sections facilitating passage of warp yarns therebetween.

11. The reed of claim 10 including rim means defined by said reduced web as extending past said web in the area of said profiled section, said rim means contacting said warp yarn end for keeping said yarn generally out of contact with said reduced web means reducing friction between said dent strip and warp yarn passing thereby.

12. The reed of claim 10 wherein said profiled section includes a contoured rear wall bowed outwardly from said plastic dent strip providing additional stiffening against beat-up.

13. The reed of claim 10 including spacer means carried by ends of said plastic dent strips for spacing said dent strips laterally in said reed frame providing uniform parallel air space between said dent strips.

14. The reed of claim 1 or 13 wherein said spacer means includes a thickness of plastic material molded onto at least one face of the opposing end of each said dent strip.

15. The reed of claim 10 including longitudinal stiffening means extending longitudinally in said dent strips carried in said frame means at the cloth-edge at opposing ends of said reed frame stiffening and reinforcing said dent strips against beat-up at said cloth edges.

16. The reed of claim 10 including tunnel recess alignment means carried by mating faces of adjacent dent strips in said reed for aligning said tunnel recesses of adjacent dent strips with one another facilitating weft insertion.

17. The reed for beating-up a weft yarn at the fell of woven fabric on a textile loom having a row of dent means providing dent spaces through which individual warp yarn ends pass, said reed comprising:

a plurality of elongated profiled dent strips constructed of plastic material having opposing free ends;

assembly means securing said free ends of said dent strips in fixed relation to from a reed frame;

a number of said dent strips including a medial profiled section;

said dent strips including shank portions connecting said medial profiled section and said free ends;

a tunnel forming recess formed in said profiled section so that said dent strips arranged generally side-by-side together create a weft insertion tunnel which contains the weft yarn and assists in guiding said yarn during insertion;

beat-up reinforcing means reinforcing said dent strips against forces produced during beat-up of said fabric;

said reinforcing means including a rear contoured wall extending rearwardly from said dent strips opposite said tunnel forming recess; and tunnel recess alignment means carried by said plastic dent strips for mating interfacing ends and aligning said tunnel recesses of said dent strips in relation to one another in said reed frame so that said recesses are in front-to-back and top-to-bottom alignment facilitating weft insertion therethrough.

18. The reed of claim 17 wherein said tunnel recess alignment means includes complementary engagement elements carried by said faces interfacing ends interlocking with one another maintaining said dent strips in vertical and horizontal position relative to one another.

19. The reed of claim 18 including a protuberance carried by a mating face of one adjacent dent strip and an indentation formed in and carried by an opposing mating face for interlocking with a protuberance of said adjacent dent strip.

20. The reed of claim 19 wherein said protuberance includes a sharp edge element and said indentation includes a groove having complementary edges interlocking therewith.

21. The reed of claim 20 including a reinforcing web formed in said plastic dent strip in the medial profiled section thereof providing additional air space between adjacent dent strips for the passage of warp yarn therebetween.

22. The reed of claim 17 including integral spacer means carried by said dent strips for spacing adjacent dent strips laterally and providing uniform parallel air spaces therebetween facilitating passages of knots and the like.

23. The reed of claim 17 wherein said assembly means includes means carried by adjoining faces of said interfacing ends of said dent strips for interconnecting adjacent dent strips together in fixed vertical and horizontal positions to form a reed frame, the width of said interfacing ends being dimensioned to fit exactly into a clamp of a lay drive by which said reed is oscillated.

24. A plastic dent for a loom reed comprising:

an elongated strip of plastic material having opposing free ends;

a medial profiled section formed in said plastic strip intermediate said free ends; and means reinforcing said plastic material in the area of said medial profiled section against cloth beat-up forces; and said reinforcing means including a rear contoured wall extending rearwardly from said plastic strip.

25. The dent of claim 24 including a tunnel forming recess formed in said profiled dent for forming a weft insertion tunnel across a number of said dents arranged side-by-side.

26. The dent of claim 24 including tunnel alignment means molds on said plastic dent for interfitting with an adjacent dent to align said tunnel recesses of said dents with one another.

27. The dent of claim 24 including spacer means molded into said plastic dent for spacing adjacent dents from one another to create a uniform parallel air space therebetween for the passage of warp yarn ends.

28. The dent of claim 24 including longitudinal stiffening means carried by said plastic strip longitudinally intermediate the ends thereof for stiffening said plastic strip against beat-up.

29. A plastic dent for a loom reed comprising:

an elongated strip of plastic material having opposing free ends;

a medial profiled section formed in said plastic strip intermediate said free ends;

means reinforcing said plastic material in the area of said medial profiled section against cloth beat-up forces;

a reduced side web formed in said profiled section reduced in thickness relative to said plastic strip creating additional air space between adjacent dents in said reed facilitating passage of warp yarns and knots and the like.

30. The dent of claim 29 including rim means around said web created by said reduced thickness for reinforcing said profiled section, said rim means maintaining said warp yarns generally out of contact with said side web for reduced friction.

* * * * *